US006062943A

United States Patent [19]

Maleika

[11] Patent Number: 6,062,943

[45] Date of Patent: May 16, 2000

[54] MOBILE TOY WITH A WHEEL AND DISK DRIVE

[75] Inventor: Hubertus Maleika, Cadolzburg-Wachendorf, Germany

[73] Assignee: STS Racing GmbH, Nürnberg, Germany

[21] Appl. No.: 09/244,157

[22] Filed: Feb. 4, 1999

[30] Foreign Application Priority Data

Feb. 4, 1998 [DE] Germany ..... 198 04 292

[51] Int. Cl.[7] ..... A63H 18/00

[52] U.S. Cl. ..... 446/444; 446/457

[58] Field of Search ..... 446/236, 431, 446/435, 444, 445, 448, 449, 453, 457, 459, 465

[56] References Cited

U.S. PATENT DOCUMENTS

| | | | |
|---|---|---|---|
| 4,045,908 | 9/1977 | Ensmann et al. | 446/444 X |
| 4,541,813 | 9/1985 | Ikeda | 446/444 X |
| 5,141,468 | 8/1992 | Suzuki | 446/435 |

*Primary Examiner*—Sam Rimell
*Attorney, Agent, or Firm*—Collard & Roe, P. C.

[57] ABSTRACT

A mobile toy, particularly for use on car racetracks with guide rails, comprises a driving motor, a driving disk mounted on an end of the toy and driven by the driving motor, and at least one toy driving wheel in direct frictional engagement with the driving disk for driving the toy.

12 Claims, 4 Drawing Sheets

MOBILE TOY WITH A WHEEL AND DISK DRIVE

BACKGROUND OF THE INVENTION

1. Field of the Invention

The present invention relates to a mobile toy, particularly for use on car racetracks with guide rails, comprising a driving motor, a driving disk mounted on an end of the toy and driven by the driving motor, and at least one toy driving wheel in driving connection with the driving disk for driving the toy.

2. Description of the Prior Art

Conventional mobile toys or model cars for use on car racetracks usually have two axles one of which is driven by an electro-motor. In most cases, the driving motor is arranged in front of the rear axle, as seen in the forward driving direction, and drives the rear axle by a gear. In one embodiment, the driving motor axle extends parallel to the axle carrying the driving wheels, two transmission gears being mounted between the axles. In another embodiment, the driving motor axle extends perpendicularly to the axle carrying the driving wheels, and the driving force is transmitted by a bevel gear transmission, which may include a freely rotating gear that may be used to carry out certain control functions.

The driving gear as well as the driven gear are subjected to considerable stress during a long-lasting operation on a car racetrack. In this connection, it must also be considered that substantial tolerances are found in toys in an effort to limit the production cost, which often leads to an early wearing out of the transmission.

SUMMARY OF THE INVENTION

It is the primary object of this invention to provide a motor-driven mobile toy in which the tendency of the drive to wear out is reduced by simple means.

The above and other objects are accomplished by the invention with a mobile toy of the first-indicated type wherein at least one toy driving wheel is in direct frictional engagement with the driving disk for driving the toy.

There is no gear transmission in such a mobile toy or model car so that no gears can be worn out. The driving disk carried by the driving motor axle directly engages the driving wheel for the toy, and preferably has a surface comprised of rubber or a resilient rubber-like material. Since the driving wheel also has a surface comprised of rubber or a resilient rubber-like material, a strong frictional engagement is achieved by the direct contact between the disk and the wheel, and this frictional driving force transmission is quiet, does not slip and has a long operating life.

According to one preferred feature, the driving motor has an axle carrying the driving disk, and the driving motor axle extends parallel to an axle carrying the toy driving wheel. This excludes the need for any angle or bevel gears, or similar angular transmission elements.

It is also possible for a respective one of the driving disks to be mounted on the driving motor axle at each side of the toy at the end thereof and a respective one of the driving wheels to be in direct frictional engagement therewith. This produces a balanced driving torque.

The mobile toy has a front axle and a rear axle, and a respective one of the driving motors is connected to each axle, according to another embodiment of the present invention. This produces an all-wheel drive imparting to the toy high acceleration possibilities. This will be particularly useful for remote-controlled toy cars which are not guided by a guide rail, and such toy cars will be able to move over considerable inclines.

The front and/or rear axles may be one-part or two-part axles. The two-part axles are advantageous when pairs of driving disks are used. If a separate motor is associated with each axle part, the power supply to each motor may be so controlled that different torque moments are applied to each driving motor axle part to produce controlled drives along curves or changes from one track to another.

According to another feature, the driving disk may be exchangeably mounted for mounting driving disks of different diameters on the toy to change the driving moment and driving speeds, or to exchange worn-out driving disks. To facilitate such adaptation, the driving motor is preferably pivotally linked to the chassis of the toy to enable the distance of the driving motor axle from the driving wheel to be changed. Advantageously, the driving motor location is so selected that the frictional pressure of the driving disk upon the driving wheel is increased when the mobile toy is driven forwardly and the driving load increases. In other words, such a driving force component is applied to the driving disk by the motor and transmitted to the driving wheel that the frictional force between driving disk and driving wheel is increased when the mobile toy is driven.

If desired, the driving wheel may be exchanged instead of the driving disk, for instance by rotating the tires from the rear to the front driving wheels.

According to yet another embodiment, the mobile toy further comprises resilient means for suspending the driving motor on the toy, the resilient means being prestressed to press the driving disk against the driving wheel frictionally engaging the driving disk. The resilient suspending means may be rotated by a suitable joint parallel to the driving wheel axle. It is also possible to provide a carriage displaceably arranged on a base plate of the toy chassis, the carriage carrying the driving motor and being under resilient prestress so that the resilient force presses the driving disk radially against the driving wheel. The carriage is displaceable in a direction extending radially to the driving motor axle.

The carriage may comprise a magnet adapted to press the mobile toy to a racetrack.

The term "driving wheel" used throughout the specification and the claims is not limited to a wheel running directly on the ground or racetrack but encompasses a stepped, smaller-diameter portion of such a wheel which is directly frictionally engaged by the driving disk, or a wheel extending parallel to a driving wheel running directly on the ground or racetrack and affixed thereto, which parallel wheel is spaced from the ground or racetrack and, therefore, has a surface which will not be soiled by contact therewith.

The mobile toy of this invention has a much enhanced operating life, reduced operating noise and great adaptability to various operating conditions.

BRIEF DESCRIPTION OF THE DRAWING

The above and other objects, advantages and features of the invention will become more apparent from the following detailed description of certain now preferred embodiments thereof, taken in conjunction with the accompanying schematic drawing wherein.

DETAILED DESCRIPTION OF THE PREFERRED EMBODIMENTS

Figure 1:
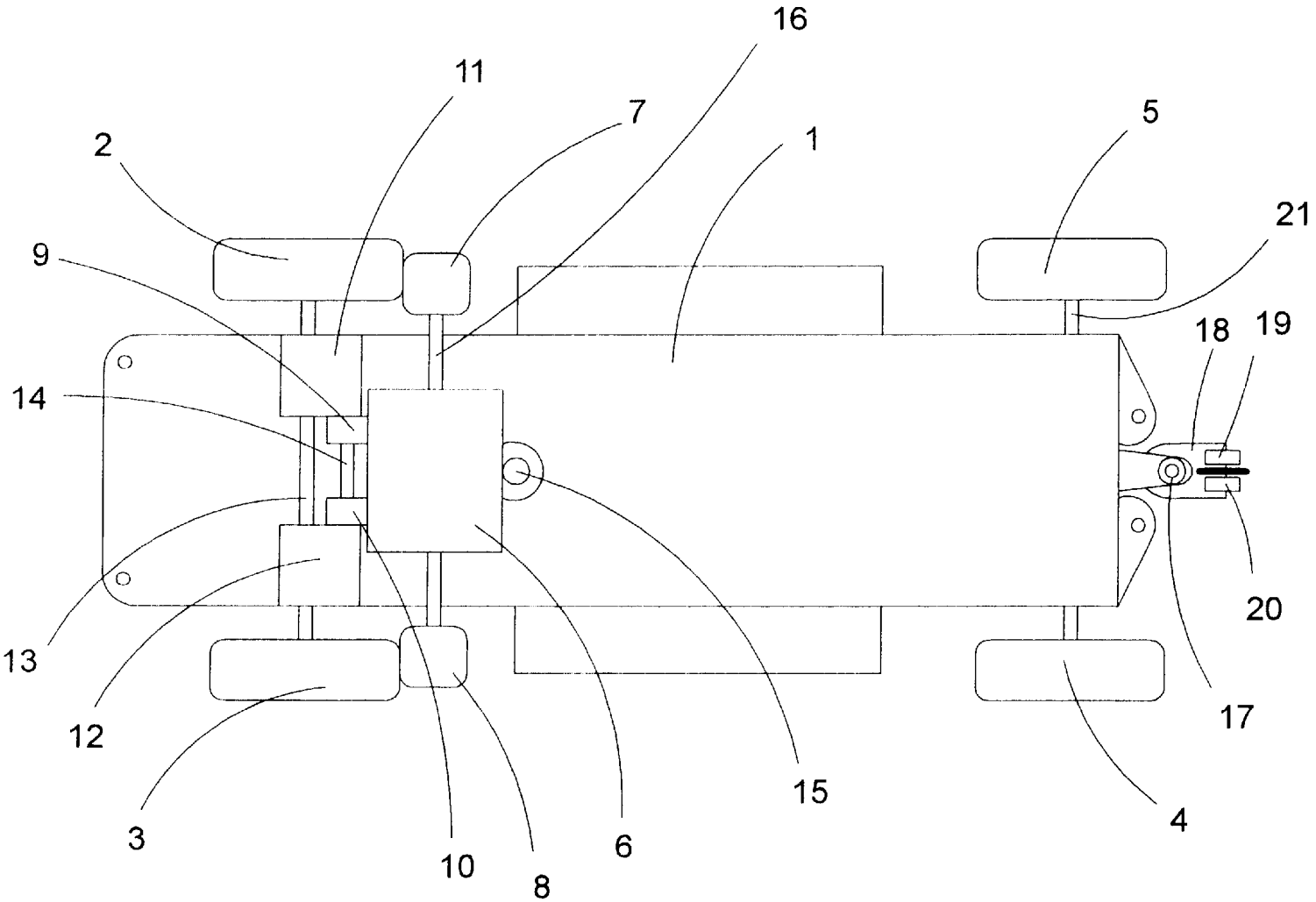
FIG. 1 is a plan view showing the mobile toy, with part of the chassis removed.

Referring to FIG. 1, there is shown a mobile toy with a base plate 1 from which the upper portion of the chassis has been removed for a better view of the essential parts of the invention. The mobile toy, which is particularly useful on car racetracks with guide rails, comprises driving motor 6, driving disks 7, 8, and toy driving wheels 2, 3 in direct frictional engagement with the driving disks for driving the toy. As shown, the toy has a front axle 21 and a rear axle 13. In the illustrated embodiment, the rear axle rigidly connects driving wheels 2, 3 to each other. The axle may be a two-part axle and, whether one-part or two-part, the axle is held in bearing blocks 11, 12. The bearing blocks may preferably be of a synthetic resin material, and in a high-quality toy, they may consist of a ball bearing for the rear axle.

Steering axle 14 extends parallel to the rear axle 13, and the steering axle carries two motor suspensions 9, 10 so that motor 6 is pivotally mounted on base plate 1. The driving motor has a driving motor axle 16 whose opposite ends carry driving disks 7, 8 at each side of the toy.

Figure 3:
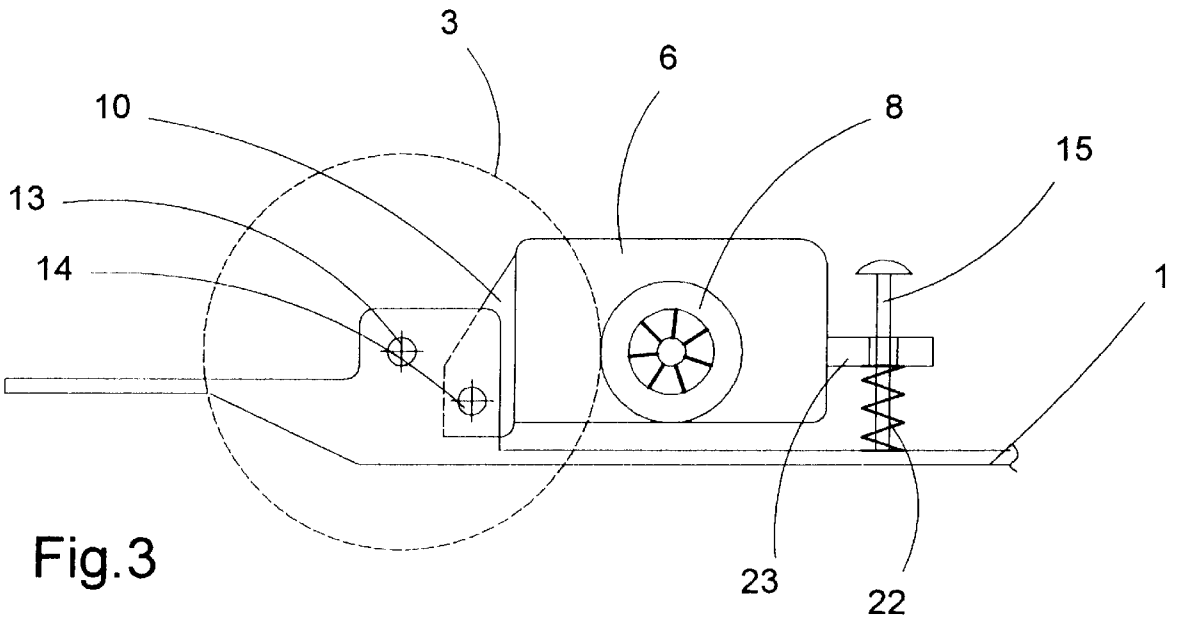
FIG. 3 is a detailed view showing one embodiment of the motor mounting.

As shown in FIG. 3, a tensioning screw 15 may so adjust the position of motor 6 in relation to steering axle 14 and rear axle 13 that driving disks 7, 8 will be pressed against driving wheels 2, 3 with sufficient force to provide the required direct frictional engagement between the disks and wheels.

While FIG. 1 illustrates a motor with two driving disks, the mobile toy of this invention may operate with a single driving disk.

Preferably, the driving disks and advantageously the driving wheels have tires of rubber or like elastic material so that the surfaces of the driving disks and wheels are in strong frictional engagement.

If the driving disks are exchangeably mounted, they may be replaced when worn, or they may be exchanged for driving disks of different diameters. As will be explained in connection with the description of FIG. 4, the pivotal mounting of motor 6 enables the changes in disk radius to be compensated.

In the illustrated embodiment, plate 18 carrying two contact brushes 19, 20 is pivotally mounted at the front end of the mobile toy by a joint 17. In this way, electric energy is supplied to the motor from a guide rail in mobile toys used on car racetracks having such guide rails.

Front wheels 4, 5 are affixed to front axle 21, which also may be a one-part or two-part axle.

In a non-illustrated embodiment of the present invention, the same frictional transmission may be used on the front wheels as has been illustrated for the rear driving wheels.

Figure 2:
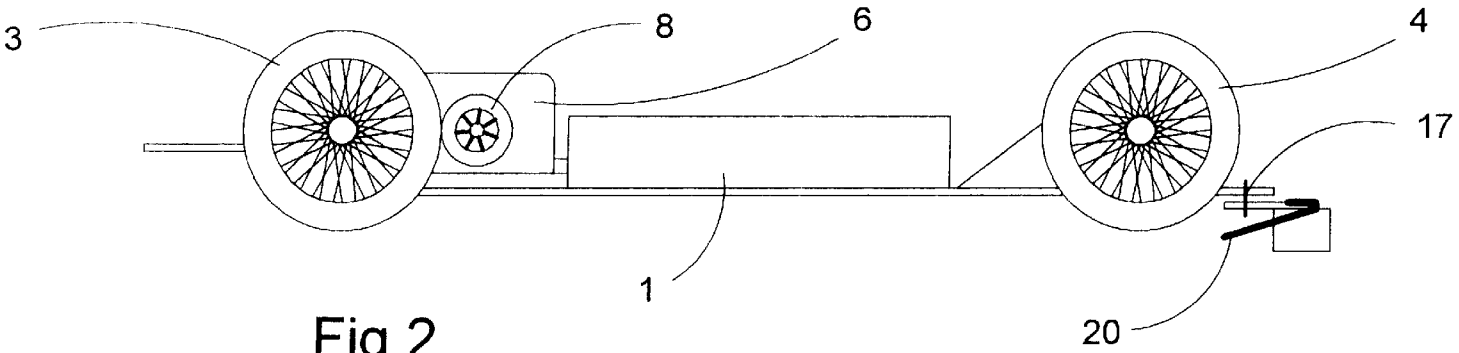
FIG. 2 is a side view of FIG. 1.

As may be readily seen from FIG. 2, driving disk 8 is in direct frictional engagement with driving wheel 3. Since the motor drives with the most efficiency when it is operated at a high rpm, the diameter of driving disk 8 is relatively small as compared to that of driving wheel 3.

As shown in the detailed view of FIG. 3, resilient means is provided to suspend driving motor 6 on the toy, the resilient means being prestressed to press driving disk 7, 8 against driving wheel 2, 3 frictionally engaging the driving disk. In this specific embodiment, motor 6 is pivotally mounted on steering axle 14. Compression spring 22 is arranged opposite steering axle 14 between base plate 1 and a retaining member 23 attached to the motor so that the motor is lifted and its driving disk is pressed against the frictionally engaged driving wheel under a predetermined prestress. Tensioning screw 15 enables the pivoting range of motor 6 to be limited. In operation of the toy, when retaining member 23 contacts the head of the tensioning screw, driving disk 8 has been worn down to such an extent that it must be replaced by a new driving disk. This is also indicated by an increased slippage between driving disk and wheel.

Figure 4:
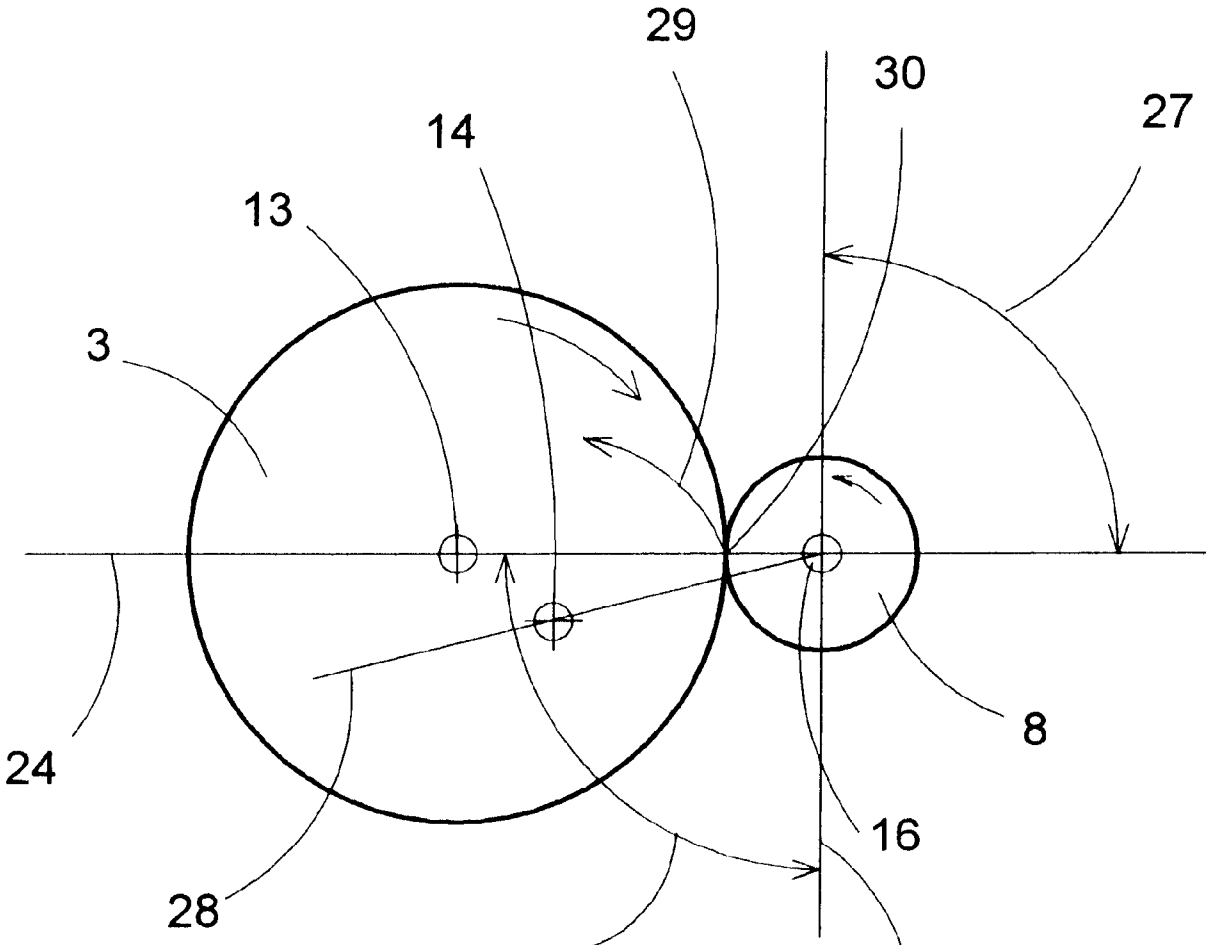
FIG. 4 is a graphic diagram illustrating the pressure forces between the driving disk and wheel during the operation of the mobile toy.

The driving connection between driving disk 8 and driving wheel 3 is diagrammatically illustrated in FIG. 4. As shown, steering axle 14 is positioned below horizontal plane 24 between rear driving axle 13 and driving motor axle 16. The line of contact 30 between the driving disk and wheel is positioned in the intersection of horizontal plane 24 and a vertical plane passing therethrough. When driving disk 8 drives driving wheel 3 in the direction indicated by the arrows, the driving moment of driving disk 8 causes axis 28 between steering axle 14 and driving motor axle 16 to be raised so that contact line 30 between the driving disk and wheel has a tendency to move in the direction of arc 29. As may be readily seen, this produces an increase in the pressure force exerted by driving disk 8 on driving wheel 3. In operation, this means that an increase in the driving force will automatically lead to an increase in the contact pressure between the driving disk and wheel. This condition is achieved when steering axle 14 is positioned within the arc 25 or 27 at a suitable distance from driving motor axle 16. The most favorable position of steering axle 14 depends on the diameters of the driving disk and wheel, and on the desired changes in the diameter of driving disk 8.

Figure 5:
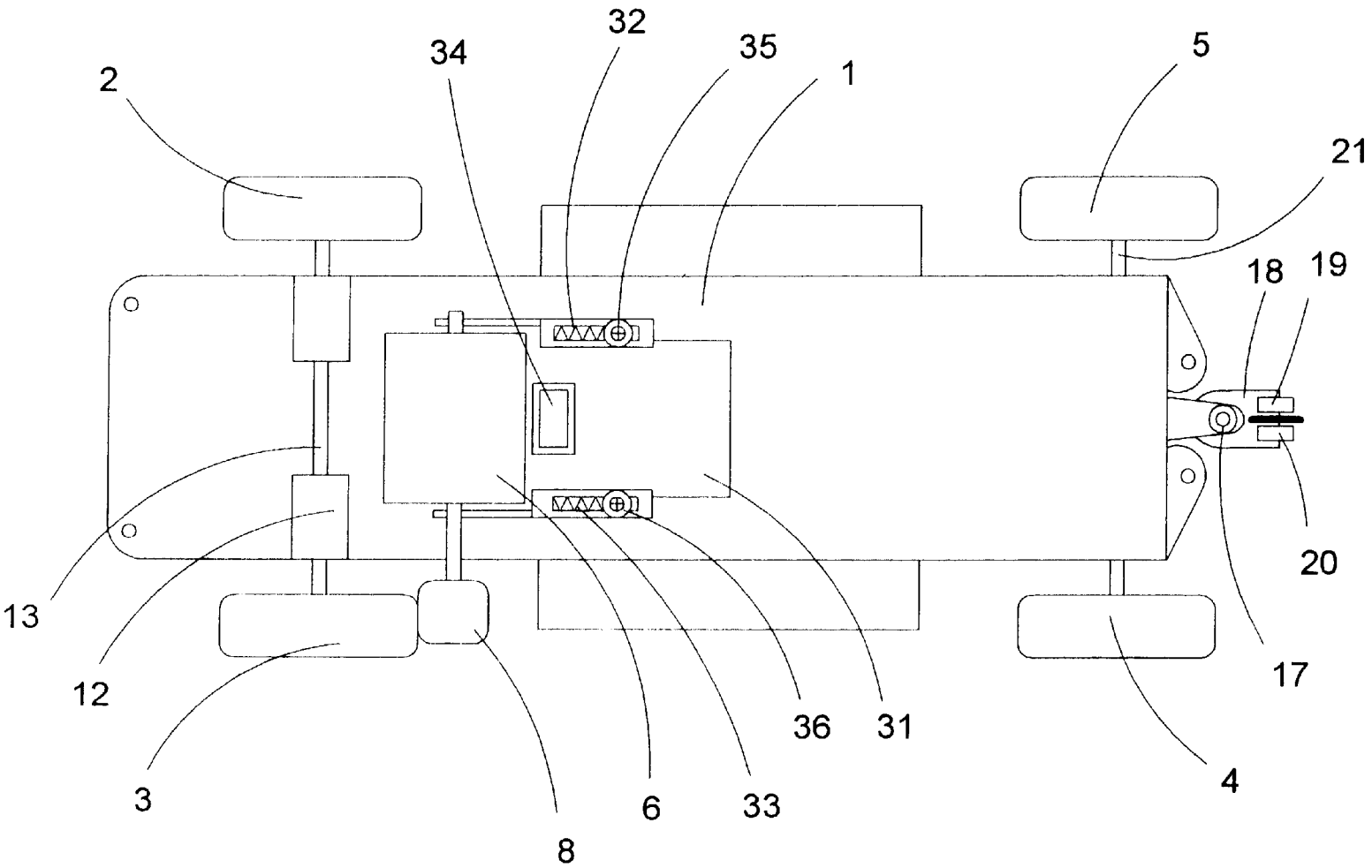
FIG. 5 is a plan view similar to that of FIG. 1 and showing another embodiment.

FIG. 5 shows another embodiment of the mobile toy of this invention, like reference numerals designating like parts operating in a like manner as in the previously described embodiment. Carriage 31 carrying driving motor 6 is displaceably mounted on base plate 1 for displacement in a longitudinal direction extending along the base plate. A pair of compression springs 32, 33 is mounted between base plate 1 and carriage 31 so that the carriage is resiliently pressed in the direction of driving wheels 2, 3. Only a single driving disk 8 is provided to transmit the driving force to driving wheel 3. Driving disk 8 applies a radial force on the driving wheel, and it may be displaced towards the same a relatively large distance, which is advantageous if a diameter change of the driving disk or the driving wheel is desired.

The carriage is held in position on the base plate by two set screws 35, 36 which are arranged in guides in carriage 31, which also hold springs 32, 33.

While several embodiments of the present invention have been shown and described, it is to be understood that many changes and modifications may be made thereunto without departing from the spirit and scope of the invention as defined in the appended claims.

What is claimed is:

1. A mobile toy, particularly for use on car racetracks with guide rails, comprising (a) a driving motor mounted on the mobile toy, (b) a driving disk mounted on the driving motor and driven by the driving motor, and (c) at least one toy driving wheel in direct and permanent frictional engagement with the driving disk for driving the toy along a race track.

2. The mobile toy of claim 1, wherein the driving disk has a surface comprised of an elastic material selected from the group consisting of rubber or a rubber-like material.

3. The mobile toy of claim 1, wherein the driving motor has an axle carrying the driving disk and the driving motor axle extends parallel to an axle carrying the toy driving wheel.

4. The mobile toy of claim 3, wherein a respective one of the driving disks is mounted on the driving motor axle at each side of toy at the end thereof, and a respective one of the driving wheels is in direct frictional engagement therewith.

5. The mobile toy of claim 4, wherein the driving motor axle is a two-part axle.

6. The mobile toy of claim 1, wherein the toy has a front axle and a rear axle, and a respective one of the driving motors is connected to each axle.

7. The mobile toy of claim 6, wherein the front and rear axles are two-part axles.

8. The mobile toy of claim 1, wherein the driving disk is exchangeably mounted for mounting driving disks of different diameters on the toy.

9. The mobile toy of claim 1, further comprising resilient means for suspending the driving motor on the toy, the resilient means being prestressed to press the driving disk against the driving wheel frictionally engaging the driving disk.

10. The mobile toy of claim 1, wherein the toy comprises a chassis and the driving motor is pivotally linked to the chassis, the driving motor location being so selected that the frictional pressure of the driving disk upon the driving wheel is increased when the mobile toy is driven forwardly and the driving load increases.

11. The mobile toy of claim 1, wherein the toy comprises a chassis including a base plate, and further comprising a carriage displaceably arranged on the base plate, the carriage carrying the driving motor.

12. The mobile toy of claim 11, wherein the driving motor has an axle and the carriage is displaceable in a direction extending radially to the driving motor axle.

* * * * *